US011189261B1

(12) United States Patent
Lu et al.

(10) Patent No.: US 11,189,261 B1
(45) Date of Patent: Nov. 30, 2021

(54) HYBRID ACTIVE NOISE CONTROL SYSTEM

(71) Applicant: SHENZHEN GOODIX TECHNOLOGY CO., LTD., Shenzhen (CN)

(72) Inventors: Youhong Lu, San Diego, CA (US); Ching-Hua Yeh, San Diego, CA (US); Hsinmin Wang, San Diego, CA (US); Jian Mao, San Diego, CA (US)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 32 days.

(21) Appl. No.: 16/888,832

(22) Filed: May 31, 2020

(51) Int. Cl.
*G10K 11/178* (2006.01)

(52) U.S. Cl.
CPC ..... *G10K 11/17853* (2018.01); *G10K 2210/3026* (2013.01); *G10K 2210/3028* (2013.01); *G10K 2210/3056* (2013.01)

(58) Field of Classification Search
CPC ..... G10K 11/178; G10K 11/17879; G10K 11/17885; G10K 2210/3022; G10K 2210/3028
See application file for complete search history.

(56) References Cited

U.S. PATENT DOCUMENTS 5,319,715 A * 6/1994 Nagami ..... G10K 11/17823 381/71.14
9,741,332 B2 * 8/2017 Asada ..... G10K 11/17879
2019/0272814 A1 9/2019 Park et al.

FOREIGN PATENT DOCUMENTS

CN 102867517 A 1/2013
CN 106063292 A 10/2016

* cited by examiner

*Primary Examiner* — Kile O Blair
(74) *Attorney, Agent, or Firm* — Kilpatrick Townsend & Stockton LLP

(57) ABSTRACT

An apparatus for canceling noise at an ear speaker includes a wideband active noise cancellation filter having a first bandwidth and configured to generate a wideband anti-noise signal from a received reference noise signal, a narrowband active noise cancellation filter having a second bandwidth smaller than the first bandwidth and configured to generate a narrowband anti-noise signal from an error noise signal, a filter between the ear speaker and an error microphone and configured to generate a feedback noise signal, and a controller. The controller is configured to eliminate the error noise signal by modifying coefficients of the wideband active noise cancellation filter and the narrowband active noise cancellation filter in response to the wideband anti-noise signal, the narrowband anti-noise signal, and the feedback noise signal.

20 Claims, 8 Drawing Sheets

400

300

400

HYBRID ACTIVE NOISE CONTROL SYSTEM

RELATED INVENTION

The present invention is related to U.S. Pat. No. 10,950,213, entitled "Hybrid Active Noise Cancellation Filter Adaptation," which is assigned to the same assignee as the present invention, and filed concurrently herewith. The full disclosure of which is hereby incorporated by reference in its entirety.

BACKGROUND OF THE INVENTION

Active noise cancellation (ANC) is to cancel noise in an area or at a location by generating a synthesized noise through an audio transducer (for example, a loudspeaker located in that area or at that location) such that the generated signal ideally has the same magnitude as that of the noise but with inverted polarity. An error sensor is also placed in that area to pick up the mix of the noise and the generated (played) synthesized noise, the result of the mix of the noise and the generated (played) synthesized noise is referred to as an error signal. ANC algorithms may be used in ANC filter designs to minimize the error signal. An error sensor can be integrated with a device (e.g., an earpiece speaker), such that ANC can be updated in real-time. Alternatively, the error sensor may not be used with a device. In this case, a fixed ANC is fitted offline.

The synthesized noise after passing through an acoustic path, referred to as a secondary path, must be as closer as possible to the noise with inverted polarity. In this way, the error signal, which is the mix of the noise and the synthesized noise, received from the error sensor is minimized or eliminated. In order to achieve the objective, the secondary path cannot delay the synthesized noise significantly because noise is varying. The synthesized noise therefore must arrive to the noise area or at the location with little delay. This requires that the secondary path delay be very short.

In order to synthesize noise, a reference noise needs be captured via a reference sensor or other means. The reference noise can be an earlier version of the noise with additional reflections of the noise via multi-paths. The synthesis of the noise can be done by applying an adaptive filter or a controller to the reference noise such that the error (difference) between the noise and the played synthesized noise is minimized. The noise synthesis must be done quickly so that it adds little delay such that the synthesized noise arrives to the noise area on time. This ANC is called feedforward ANC. Since there is a reference sensor to sense the earlier version of the noise, feedforward ANC can cancel relatively wideband noise. Therefore, the feedforward ANC is referred to as the wideband (WB) ANC throughout the present disclosure.

If a noise is narrowband noise or includes several tonal signals, a synthesized noise can be predicted from the narrowband noise. Thus, ANC uses an error signal from an error sensor to estimate the noise from it and predicts the noise from the estimation. This type of ANC is referred to as feedback ANC in which the reference sensor is not needed. The prediction performance is higher with lower waterbed effect (undesired noise with a relatively narrow frequency band) if the secondary path and processing have low latency. Thus, for certain bandwidths, the feedback ANC has better performance with lower latency. If a signal is not narrowband, the narrowband requirement can be achieved by emphasizing some frequency bands where noise reduction is desired. It is referred to as narrowband (NB) ANC.

In order to cancel both wideband (WB) and narrowband (NB) noises, WB and NB ANCs can be mixed to form a mixed ANC, which is referred to as hybrid ANC. There are several ways to implement hybrid ANCs. For example, a WB ANC can be first optimized followed with optimizing an NB ANC independently, or verse versa. Alternatively, the WB ANC and NB ANC can be jointly optimized.

ANC can be realized with analog circuits. For lightweight devices, active resistor and capacitor (RC) circuits are very effective for analog ANC designs. It is however difficult to change the RC circuit parameters in real-time to adapt to varying environments. In addition, the device acoustics may be different from one device to another device even if they are of the same type. This requires using different component values in the RC circuits for each device, which requires considerable design effort and presents an insurmountable obstacle in mass production.

Digital designs are more flexible than analog designs because processing with modern algorithms can be realized easily with a digital component, such as a digital signal processor (DSP) or the like. Therefore, ANC has been realized with digital circuits. Filtered LMS algorithms with FIR filters are widely used in ANC designs.

A hybrid ANC generally uses a feedback filter to predict the noise for canceling low frequency and/or tonal-like noise and uses a feedforward filter to synthesize anti-noise from a reference noise for canceling broadband or wideband noise. Both analog and digital circuits are used. Low speech digital circuits with advanced algorithms have been successfully used for ANC designs in many years. But the noise cancellation performance is limited due to high latency in the playback synthesized noise path. Furthermore, advanced algorithms require fast digital processing circuits which have high computational cost and power consumption.

From the above, it can be appreciated that novel techniques for improving active noise control devices and methods are highly desired.

BRIEF SUMMARY OF THE INVENTION

The present invention generally relates to active noise cancellation or control, and more particularly, to an apparatus, system, and method for cancelling noise utilizing low latency digital signal processing techniques. One such active noise cancellation apparatus includes a reference microphone, an error microphone, and hybrid noise cancellation circuitry having a wideband noise cancellation filter of a first bandwidth, a narrowband noise cancellation filter of a second bandwidth smaller than the first bandwidth, and a feedback filter having an impulse response which represents an acoustic path between an ear speaker and the error microphone, and some associated sensor drive circuits.

According to an aspect of the present invention, an apparatus for cancelling noise includes a reference microphone configured to receive a reference noise signal, an error microphone configured to receive an error signal at or in the vicinity of a user's inner ear, and a hybrid noise cancellation circuit. In one embodiment, the error microphone is disposed in the vicinity of the inner ear for a headset. In another embodiment, the error microphone is disposed inside the inner ear for an earpiece. The hybrid noise cancellation circuit includes a wideband noise cancellation filter having a first bandwidth and configured to generate a wideband anti-noise signal, a narrowband noise cancellation filter having a second bandwidth smaller than the first bandwidth and configured to generate a narrowband anti-noise signal from an error noise signal, and a feedback filter having an impulse response representing an acoustic path between an ear speaker and the error microphone and configured to generate a feedback noise signal. The error noise signal is reduced through a real-time update of coefficients of the wideband and narrowband noise cancellation filters in response to the wideband anti-noise signal, the narrowband anti-noise signal, and the feedback noise signal.

In one embodiment, the error noise signal is applied to the narrowband noise cancellation filter with a sample ahead of the narrowband anti-noise signal by a sample time interval. In one embodiment, the wideband noise cancellation filter includes an infinite impulse response filter. In one embodiment, the narrowband noise cancellation filter includes an infinite impulse response filter.

In one embodiment, the apparatus also includes a variable gain amplifier coupled to the narrowband noise cancellation filter and configured to generate a scaled narrowband anti-noise signal is utilized to cancel or reduce noise of a received audio signal.

According to another aspect, an apparatus for canceling noise at an ear speaker may include a wideband active noise cancellation (WBANC) filter having a first bandwidth and configured to generate a wideband anti-noise signal from a received reference noise signal, a narrowband active noise cancellation (NBANC) filter having a second bandwidth smaller than the first bandwidth and configured to generate a narrowband anti-noise signal from an error noise signal, a filter having an impulse response representing an acoustic path between the ear speaker and an error microphone and configured to generate a feedback noise signal, and a digital input port configured to receive a digital audio signal. The wideband anti-noise signal and the narrowband anti-noise signal are configured to reduce or cancel environmental noise to an area, for example, human ears.

According to still another aspect, a method for canceling noise at a user's inner ear is provided. The method includes receiving a reference noise signal from a reference microphone, generating a wideband anti-noise signal by applying a wideband noise cancellation filter having a first bandwidth to the reference noise signal, receiving an error signal from an error microphone disposed at a vicinity of the user's inner ear, generating a narrowband anti-noise signal by applying a narrowband noise cancellation filter to an error noise signal, the narrowband noise cancellation filter having a second bandwidth smaller than the first bandwidth, generating a feedback signal by a filter having an impulse response representing an acoustic path between an ear speaker and the error microphone, and updating coefficients of the wideband noise cancellation filter and the narrowband noise cancellation filter in real-time as a function of the error noise signal.

In one embodiment, updating coefficients of the wideband noise cancellation filter and the narrowband noise cancellation filter in real-time includes computing a difference between the error signal and the feedback signal to obtain the error noise signal, and adjusting the coefficients of the wideband noise cancellation filter and the narrowband noise cancellation filter to minimize the error noise signal.

In one embodiment, the error noise signal is provided to the narrowband noise cancellation filter with a sample ahead of the narrowband anti-noise signal by a sample time interval.

In one embodiment, the method further includes receiving an audio signal, canceling noise in the audio signal by adding the wideband and narrowband anti-noise signals to the audio signal, and providing a noise-canceled audio signal to the ear speaker.

In one embodiment, the wideband and narrowband anti-noise signals and the audio signal are discrete time domain signals.

In one embodiment, the method further includes applying an interpolation operation to the discrete time domain audio signal to have a same sampling rate as the wideband and narrowband anti-noise signals.

Other features, benefits and advantages will become apparent from the following detailed description. These embodiments of the present invention along many of its advantages and features are described in more detail in conjunction with the text below and attached figures.

DETAILED DESCRIPTION OF THE INVENTION

Figure 1A:
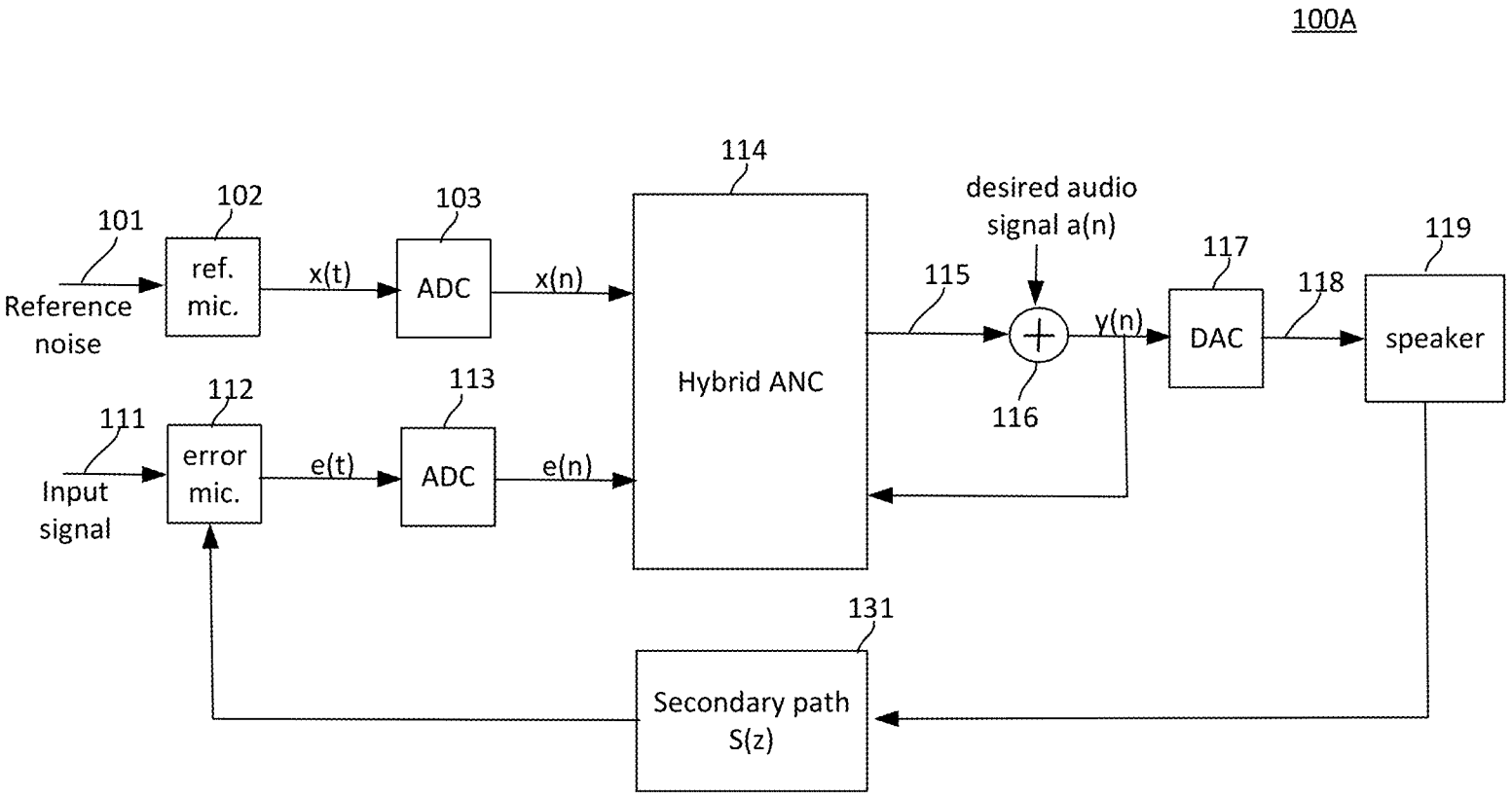
FIG. 1A is a simplified block diagram of an adaptive hybrid active noise cancellation (ANC) system according to an embodiment of the present disclosure.

Embodiments of the present invention provide apparatus, device, and methods of low latency active noise cancellation which avoid the problems of high latency, high power consumption, and high computational costs associated with sampling rate conversion techniques that utilize pulse-density modulation and sigma-delta modulation and real-time filter adaption techniques that compromise filter stability in active noise cancellation. Embodiments of the present invention utilize a wideband active noise cancellation filter disposed between a reference microphone and a speaker, a narrowband active noise cancellation filter disposed between an error microphone and the speaker, and a filter disposed between the error microphone and the speaker, i.e., arranged in parallel with the narrowband active noise cancellation filter.

The novel technical solutions can be applied to a large variety of wearable audio devices, such as in cellular phones, phone headsets, audio players (MP3).

Many theoretical studies of digital ANC are known. However, their performance is limited due to the following factors: 1) high latency due to the secondary path and processing delays, 2) high processing and hardware power consumption, and 3) high hardware cost for lightweight devices.

In the earlier ANC, the signals from both reference sensor and error sensor are sampled with a lower sampling rate (16 ksamples/s or 8 ksamples/s, for example) to reduce power consumption and hardware cost. A digital signal processing (DSP) device receives these signals and processing them and synthesizes a signal to play back to the noise area. Because the sampling rate is low, processing power requirements are small and FIR filters can be used as adaptive filters or ANC controller.

Although the earlier digital ANC works, it has limited performance due to a longer secondary path and processing latency so that a synthesized noise cannot arrive timely to the noise area. Low sampling rates will increase latency because group delays due to ADC and DAC depend on a certain number of samples. The delay of each sample in low sampling rates is also large. In addition, DSP adds latency of several samples due to processing and buffering delays.

Current digital devices can operate at a very high sampling rate. For example, sampling rates higher than or equal to 768 ksamples/second are seen in ANC products in recent years. The secondary path latency is low in this case. In order to reduce the power consumption and hardware cost, there is little real-time ANC processing done in the device. IIR filters are used in almost all ANC devices in recent years because the number of taps in HR filters are very small resulting in small processing requirements.

Many digital ANC devices use IIR filters as ANC filters and controllers. The frequency response of the main path and secondary path are measured offline. Coefficients of ANC filters and controllers are generated through fitting algorithms offline and then written into ANC registers for real-time ANC processing. Taking a headset on a man-made head as an example, reference microphone and error microphone are connected to a recording device to record frequency response of the microphones while playing sweep tones outside of the headset. Using various combination of recordings, ANC filter coefficients can be computed via a personal computer (PC) or other computing devices.

The ANC coefficients in this case are fixed in a device. The requirements to the processing are low so that hardware cost and power consumption are very low. The performance of ANC may be good if the main path and the secondary path do not change in an ANC device. In practice, device acoustics vary from one device to another. Even with the same device, the acoustics performance may vary with environments and user's head. Therefore, such ANC may be relatively robust for well-designed devices, such as some professional headsets. It is difficult to achieve good performance for earpieces with relaxed acoustic design requirements.

In order to improve ANC performance with varying acoustics, the proposal to perform ANC with high-speed hardware while ANC coefficients are trained in real-time in low-speed hardware has been seen recently. However, the approach has the following drawbacks: (1) converting ANC filters from low-speed pulse-code modulation (PCM) domain to high-speed pulse-density modulation (PDM) domain is realized with hardware similar to a sigma-delta modulation, which may add delay due to operation of PCM to PDM so that the advantage of the high-speed operation and low-filter order may be lost; (2) most operations of low-speed ANC filter adaptation follow existing digital adaptive ANC with emphasis on adaptation control to components of filters mostly for stability, which may not be efficient; and (3) there are practically no ANC designs based on ANC performance specifications.

The present inventors found that: (1) there is a need to address an advanced hybrid ANC in which full and complex adaptive algorithms can be used to update adaptive filters and controllers in real-time; (2) there is a need to address the advanced hybrid ANC such that ANC performance is higher with all kinds of environments and/or devices; (3) there is a need to address an ANC such that a designed ANC has desired performance specified by a user according to the user's device and user experience; (4) there is a need to do ANC filter adaptation in an efficient way; and (5) there is a need to have efficient converter of ANC filters from low-sampling rate to high-sampling rate such that the filter's orders are in the similar range, its frequency response is the same in the frequency bands of interest, and minimal or zero in other frequency bands. Other needs in accordance with the present disclosure are also contemplated.

The present inventors thus proposed novel hybrid ANC solutions to address the full and complex adaptive algorithms with efficient implementation in real-time. The beneficial features include mapping of ANC filter coefficients from a low-frequency range to a high-frequency range, and incorporating user's performance specifications in the design of ANC. The obtained performance is higher with all kinds of environment because the adaptation of all filter coefficients occurs in real-time. Other advantages in accordance with the present disclosure are also contemplated.

I. Novel Adaptive ANC Systems

FIG. 1A is a simplified block diagram illustrating an adaptive hybrid active noise cancellation (ANC) system 100A according to an embodiment of the present disclosure. The adaptive hybrid ANC system 100A may be an earpiece that includes a reference microphone 102 for picking up a reference noise 101 in a given area or at a given location and generating an electrical signal x(t), and a first analog-to-digital converter (ADC) 103 for sampling the electrical signal x(t) and generating a sampled signal x(n). The adaptive hybrid ANC system 100A also includes an error microphone 112 for picking up an input signal 111 (which may include an audio signal and residual noise signal in the earpiece) and generating an electrical signal e(t), and a second ADC 113 for sampling the electrical signal e(t) and generating a sampled signal e(n).

Sampled signals x(n) and e(n) are provided to a hybrid ANC circuit 114 to obtain an anti-noise signal 115 that is added to a desired audio signal a(n) by an adder 116 to cancel or reduce the reference noise. The noise reduced audio signal y(n) is provided to a digital-to-analog converter (DAC) 117, which outputs an analog audio signal 118 to an earpiece (speaker) 119 that produces sounds to a user. The adaptive hybrid ANC system 100A further includes an acoustic feedback path (secondary path) 131 between the earpiece 119 and the error microphone 112 including the ADC 113 and DAC 117. In an alternative embodiment, the error microphone 112 may only pick up a feedback noise signal ef(t) from the ear piece (speaker) 119 so that the input signal 111 is not present. Although two ADC (103, 113) are shown, it is understood that the analog-to-digital conversion operations for the reference noise x(t) and electrical signal e(t) can be performed by a single ADC device. As used herein, the term "adder" refers to a circuit, an arithmetic logic unit, digital logic or software program that combine two or more signals by arithmetic addition and/or subtraction. It is noted that the term "adder" is used in the disclosure for brevity sake, it is understood that it refers to a logic unit that performs arithmetic add/subtract functions or addition/subtraction operations. The adder, alternatively referred to as a logic unit, may include two or more inputs for receiving digital (e.g., binary) values and outputting digital data (e.g., a number of bits) as a result. The ear piece, ear speaker, ear phone, earpiece, speaker, earphone may be interchangeably used and refer to an electro-acoustic transducer that convert electrical signals to sound. The desired audio signal may be a digital recording, streaming or broadcasting of a piece of music or sound that a user wants to listen to.

Other adaptive hybrid ANC systems are also possible according to some embodiments of the present disclosure. For example, for cost and fidelity reasons, a fully digital audio system may include a digital audio source (i.e., a digital microphone having a built-in analog-to-digital converter), digital hybrid ANC circuitry, and a digital audio amplifier, which drives the speaker. Of course, other alternative systems utilizing ANC embodiments of the present disclosure are apparent to those skilled in the art having reference to this disclosure. As used herein, the terms "wideband noise cancellation filter," "wideband active noise cancellation filer," "wideband active noise control filter," and "wideband ANC filter" are interchangeably used. Similarly, the terms "narrowband noise cancellation filter," "narrowband active noise cancellation filer," "narrowband active noise control filter," and "narrowband ANC filter" are interchangeably used.

Figure 1B:
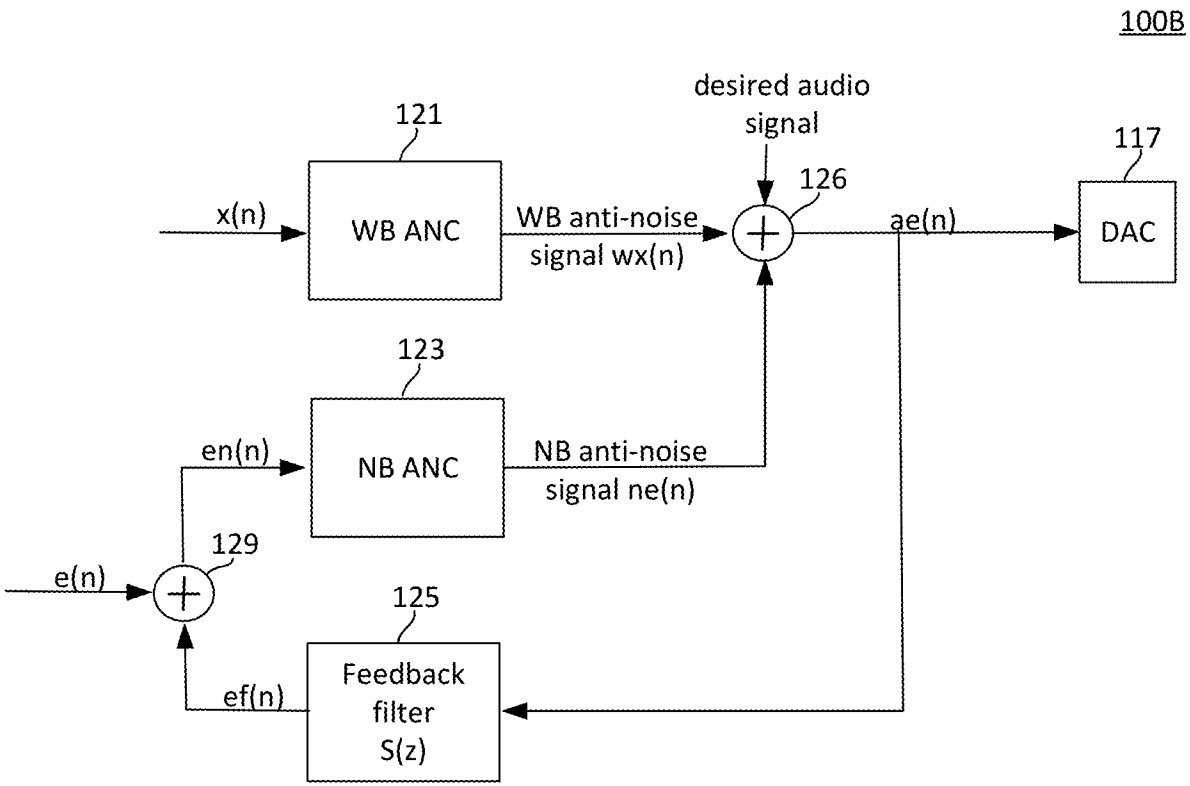
FIG. 1B is a simplified block diagram of the hybrid ANC of FIG. 1A.

FIG. 1B is a simplified block diagram illustrating an embodiment of adaptive hybrid ANC system 100B of FIG. 1A. The adaptive hybrid ANC system 100B is shown as including a wideband ANC filter 121 configured to receive the sampled reference signal x(n) and output a wideband anti-noise signal wx(n), and a narrowband ANC filter 123 configured to receive an error noise signal en(n) which is a mix of the sampled signal e(n) and a feedback signal ef(n) and output a noise signal ne(n), which is NB anti-noise to be played out around the error microphone. The adaptive hybrid ANC 100B also includes a feedback filter 125 having an impulse response S(n) representing the acoustic path between the digital audio signal a(n) (before the DAC 117) and the sampled signal e(n) (after the second ADC 113 of the error microphone 112). The feedback filter 125 is configured to receive an audio signal ae(n), which may include a residual error signal and provide a filtered signal ef(n) at its output.

In accordance with the present invention, the full and complex adaptive algorithms can be used to update coefficients of adaptive filters in real-time with an efficient implementation. The ANC performance is higher in various types of environmental noise because the adaptation is in real-time for all coefficients. The proposed ANC filter can achieve the desired performance according to user experience and around specification. The conversion of ANC filters from a low-sampling rate to a high-sampling rate is performed via DSP or similar hardware.

The proposed hybrid ANC is based on an adaptive filtering architecture with different adaptive filter design algorithms. Thus, the foundation is based on the adaptive filtering theory. The proposed hybrid ANC can be based on a control architecture with different controller design algorithms, in which the control theory can serve as its design foundation.

Figure 1C:
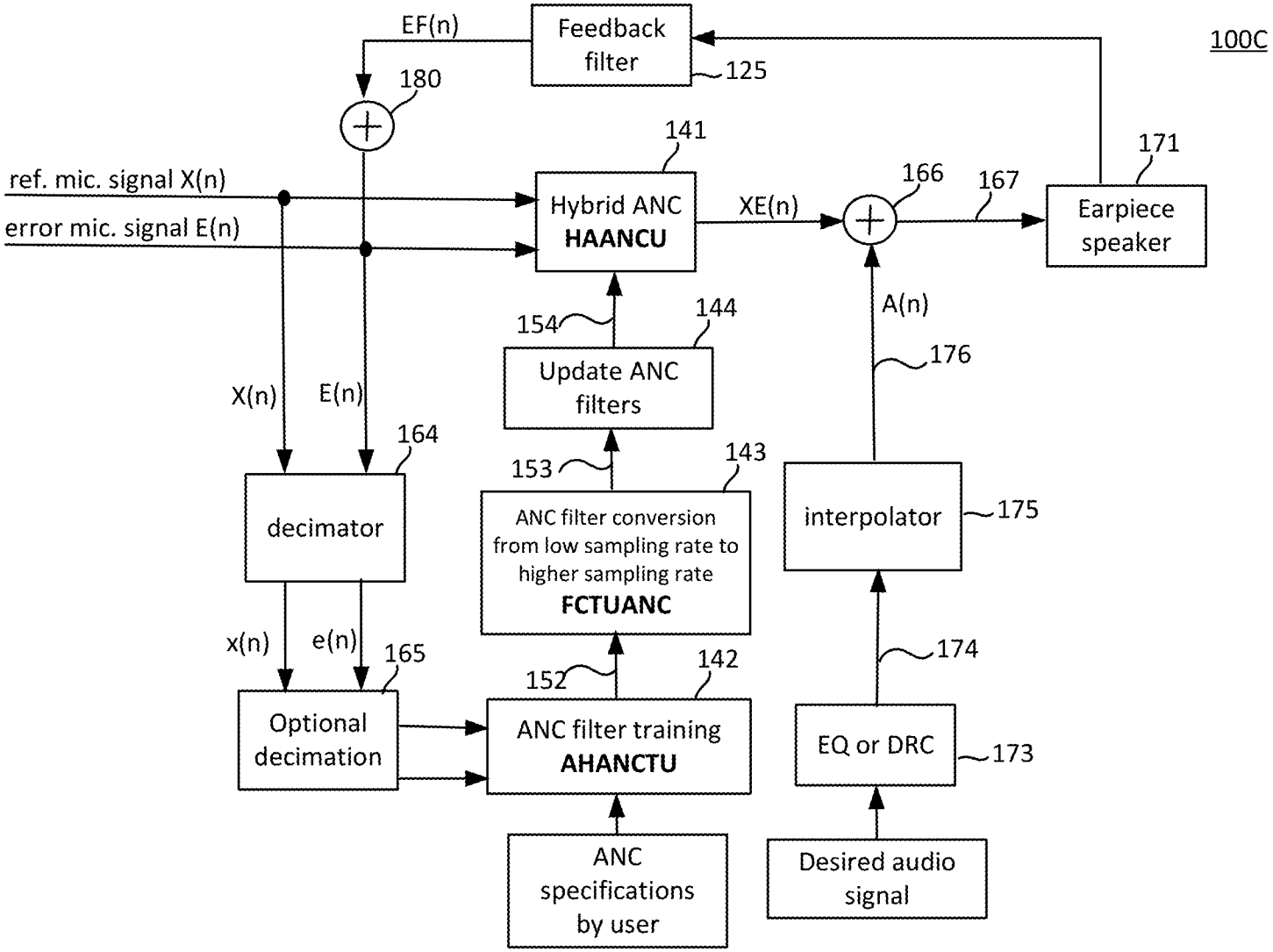
FIG. 1C is a simplified block diagram of an adaptive hybrid ANC system according to an embodiment of the present disclosure.

FIG. 1C is a block diagram of an adaptive hybrid ANC system 100C according to some embodiments of the present invention. The reference microphone, the error microphone, the ADCs, the DAC and the speaker in FIG. 1C are not shown herein for clarity reasons.

Referring to FIG. 1C, the proposed adaptive hybrid ANC system 100C includes three main components:

(1) Hybrid adaptive ANC unit (HAANCU) 141 operating at high speed, e.g., at a sampling rate greater than times the Nyquist rate of down-sampled signals in low-speed unit 142, and mainly performing filtering operations to achieve noise reduction where adaptive coefficients are updated continuously from an ANC filters update unit 144 in real-time;

(2) Adaptive hybrid ANC training unit (AHANCTU) 142 operating at a lower speed (e.g., a sampling rate lower than 10 times the Nyquist rate) obtaining coefficients of hybrid ANC filters in lower selected frequency range via a combination of algorithms, external specifications, and equalizers where adaptive coefficients are outputted to an ANC filter conversion unit 143;

(3) Filter conversion unit of ANC (FCUANC) 143 converting adaptive filters and/or controllers from a low-frequency range to a higher-frequency range, which is used in HAANCU 141. It is important that frequency responses of input and output filters are substantially the same in the frequency range that an ANC cancels the noise. Interpolation methods with delay are not recommended and would not work well with embodiments of the present disclosure.

As used herein, the term "unit" refers to a device, which includes at least one programmable hardware element, a logic circuit, or a combination of hardware logic and software program. Software program may, for example, enable a user to enter the active noise cancellation specifications (denoted as "ANC specifications") to the ANC system, select and update the ANC algorithms according to application requirements, and/or modify the adaptive hybrid ANC architectures. The term "device" refers to a unit including a combination of hardware and software that can perform noise cancellation operations or functions. The device or unit may include adaptive finite impulse response (FIR) filters, infinite impulse response (IIR) filters, analog-to-digital converters (ADC), digital-to-analog converter (DAC), and sampling rate converters. The term "real-time" refers to cause and effect that occur without noticeable time lag or without significant time delay between the cause and effect but not necessary at the same time.

The adaptive hybrid ANC system 100C further includes a decimator 164 which down-samples the reference noise signal X(n) by the ADC 103 to a down-sampled reference signal x(n) and the input signal E(n) by the ADC 113 to a down-sampled error signal e(n). In an example embodiment, the decimator 164 may have a decimation factor of 16. For example, when the ADC 103 and ADC 113 have a sampling rate of 768 ksamples/s, the decimator 164 will reduce the signals to a sampling rate of 48 ksamples/s. In one embodiment, the adaptive hybrid ANC system 100C may also include a second decimator 165 which may further reduce the sampling rate of 48 ksamples/s to 16 ksamples/s. In one embodiment, the decimators 164 and 165 can be combined. The down-sampled signals are provided to the ANC filter training unit (AHANCTU) 142 for obtaining filter coefficients 152 for the hybrid adaptive ANC unit (HAANCU) 141 via an ANC filter conversion unit 143 and an update ANC filter unit 144. The thus obtained filter coefficients 152 are converted to filter coefficients 153 at a higher sampling rate by the ANC filter conversion unit 143 for updating the filters coefficient 154 in the hybrid adaptive ANC unit (HAANCU) 141 by the update ANC filters unit 144. The filter output from the ANC filer conversion unit 143 is required to have substantially the same frequency response in the frequency range of noise-canceling and its amplitude frequency response above the noise-canceling frequency range is small for preventing amplification of noise. The hybrid adaptive ANC unit (HAANCU) 141 outputs an anti-noise signal XE(n), which is mixed with an audio signal A(n) 176 by an adder 166 to provide a noise-reduced audio signal 167 to an audio transducer 171 (e.g., an earpiece speaker).

The adaptive hybrid ANC training unit (AHANCTU) 142 also includes an input for receiving ANC specifications provided by a user. The adaptive hybrid ANC system 100C may also include an equalizer or a dynamic range controller 173 for equalizing the desired audio signal to an equalized audio signal 174 and an interpolator 175 to convert the equalized audio signal to an audio signal 176 having an oversampling rate substantially equal to the sampling rate of the original digital reference microphone signal and error microphone signal.

Referring to FIG. 1C, the terms X(n), E(n), and A(n) refer to up-sampled or over-sampled discrete-time signals with respect to x(n), e(n), and a(n), which are a sequence of real or complex values, into down-sampled discrete-time signals x(n), e(n), and a(n), respectively. The terms X(z), E(z), and A(z) refer to up-sampled or over-sampled signals in the complex frequency-domain representation.

In one embodiment, the hybrid adaptive ANC unit (HAANCU) 141 may be implemented in hardware or a combination of hardware and software, the adaptive hybrid ANC training unit (AHANCTU) 142 and the filter conversion unit of ANC (FCUANC) 143 may be implemented by a digital signal processor (DSP). As used herein, these units may include hardware and/or software components that are described in detail below. The term "unit" may also be referred to an apparatus, a device, or a system including hardware logic, memory, one or more processing units, and software programs running instructions to control operations of the adaptive noise cancellation system.

II. Hybrid Adaptive ANC Unit (HAANCU)

Figure 2:
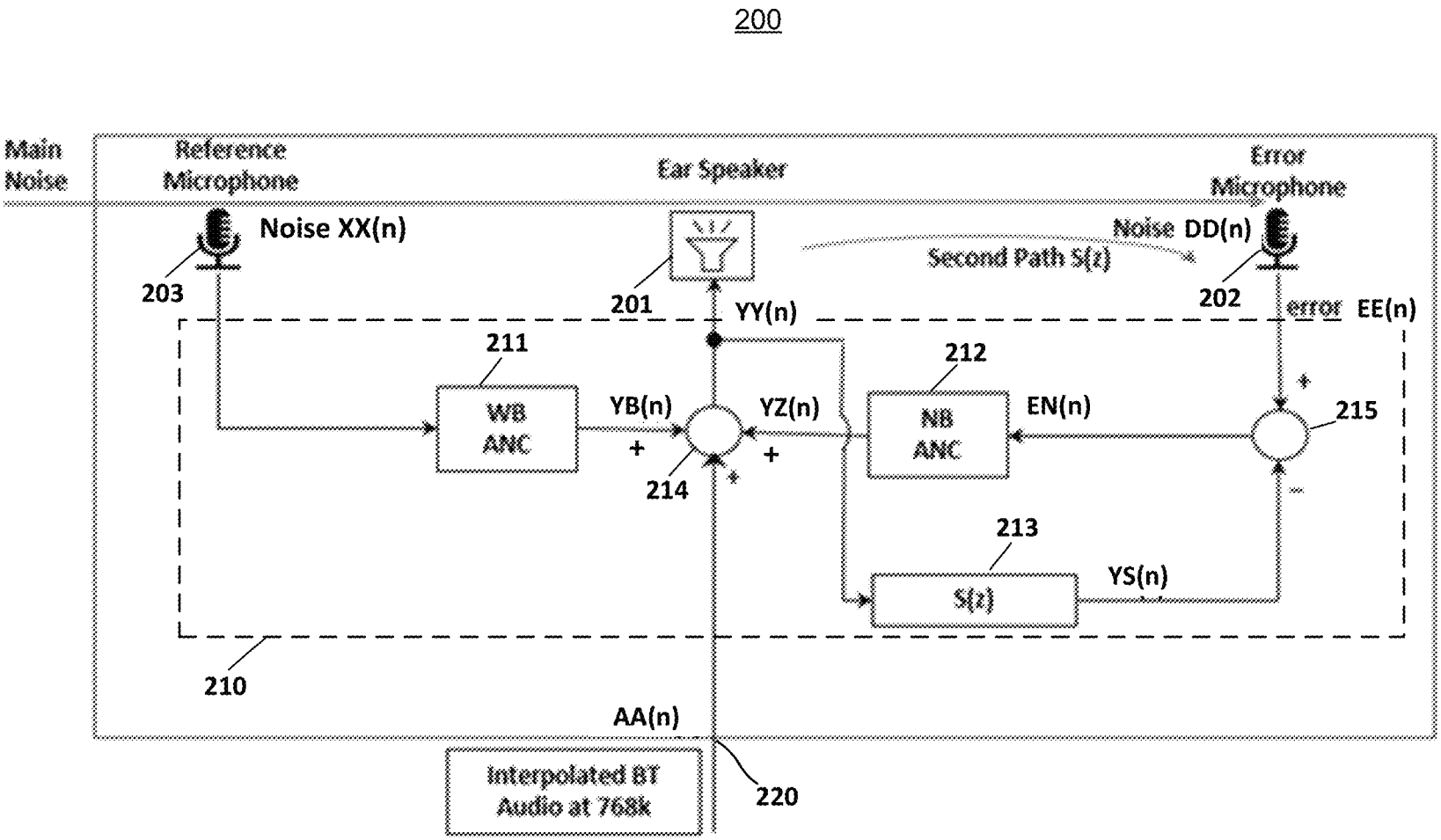
FIG. 2 is a simplified block diagram of an adaptive hybrid noise cancellation system when the adaptive ANC system including a secondary path is operating at high sampling rates according to an embodiment of the present disclosure.

FIG. 2 shows a simplified block diagram of an HAANCU system 200 used as a high sampling rate ANC according to an embodiment of the present disclosure. The HAANCU system 200 may be an audio device (e.g., a mobile phone, a noise reducing system, a portable personal audio listening device) or an earpiece that includes components relevant to improve the adaptive noise cancelation process. Referring to FIG. 2, the HAANCU system 200 includes an audio transducer (e.g., an ear speaker) 201, an error microphone 202 positioned close to the ear speaker 201, and a reference microphone 203 integrated in the audio device. The HAANCU system 200 also includes a hybrid noise cancellation device (also referred to as unit) 210, which includes a wideband adaptive noise cancellation (WB ANC) filter 211, a narrowband adaptive noise cancellation (NB ANC) filter 212, a feedback filter 213 having an impulse response S(n) representing an acoustic path (secondary path) between the ear speaker and the error microphone, and a first adder 214 configured to add (sum or mix) wideband anti-noise YB(n) at the output of the WB ANC filter 211, the narrowband anti-noise YZ(n) at the output of the NB ANC filter 212, and a desired audio signal AA(n). The summed (mixed) result YY(n) is provided to the ear speaker 201. The hybrid noise cancellation device (unit) 210 also includes a second adder 215, which sums a feedback noise signal YS(n) at the output of the feedback filter S(n) and the error signal EE(n) to generate an error noise signal EN(n) to the NB ANC filter 212. It is noted that the use of the terms first, second, etc. do not denote any order, but rather the terms first, second, etc. are used to distinguish one element from another. Furthermore, the use of the terms a, an, etc. does not denote a limitation of quantity, but rather denote the presence of at least one of the referenced items.

The hybrid noise cancellation device (unit) 210 further includes a controller 217 configured to update the coefficients of the WB ANC filter 211 and the NB ANC filter 212. The controller 217 modifies the coefficients of the WB ANC filter 211 and the NB ANC filter 212 in real-time by performing digital addition, subtraction, multiplication to reduce the error noise signal EN(n) at the input of the NB ANC filter 212. The controller 217 may include a real-time digital signal processor (DSP) including nonvolatile memory, randon access memory and software programs for updating the transfer functions of the WB ANC filter 211 and the NB ANC filter 212. In one embodiment, the controller includes one or more DSP modules that are centralized to update the coefficients of the WB ANC filter 211 and the NB ANC filter 212 in real time. In one embodiment, the controller 217 may include one or more DSP modules that are distributed in the WB ANC filter 211 and the NB ANC filter 212 to perform real-time update of the filter coefficients.

The error microphone 202 is configured to pick up the summed sound of the ear speaker just before the user's inner ear, the summed sound may include the audio signal AA(n), the wideband anti-noise YB(n), and the narrowband anti-noise YZ(n). The reference microphone 203 is configured to pick up background acoustic noise XX(n), but not the sound emitted by the ear speaker. Ideally, the anti-noise is the same as the noise but with an inverted phase in the inner ear area to prevent noise from entering the user's inner ear, i.e., the anti-noise cancels the noise before it enters the user's inner ear. In this case, a signal received by the error microphone is reduced or eliminated. The audio signal AA(n) is provided to the HAANCU system 200 from a digital input port 220. The audio signal AA(n) includes interpolated samples of an analog audio signal at a sampling frequency or sampling rate. It is noted that the audio signal AA(n) is shown as oversampled at 768 ksamples/s, however, it is understood that this sampling rate is arbitrary chosen for describing the example embodiment and should not be limiting. In some embodiment, the sampling rate can be chosen within a sampling rate range having an upper and lower limits different from this sampling rate value.

As used herein, the reference symbols YB(n), YY(n), YZ(n), XX(n), EN(n), EE(n), DD(n), and AA(n) denote time sequences of discrete values in the time-domain, where n is the sampling time index. However, the embodiment is not limited to the time-domain processing operations. One of skill in the art would understand that the digital signal processing may be performed in the frequency domain through transform operations from the time domain into the frequency domain.

The input to the WB ANC filter 211 is a signal from the reference microphone that captures noise before the noise travels to the user's inner ear. The WB ANC filter output is a wideband anti-noise because it can cancel noise up to a few thousands of Hertz.

The NB ANC filter output is a narrowband anti-noise because it cancels noise in narrowband and/or tonal noises. The input to the NB ANC filter 212 is the noise estimated from the error signal via adding the synthesized noise filtered with an estimated secondary path impulse response. The signal traveling path from the ear speaker to the error microphone including ADC and DAC converters (not shown) is referred to as a secondary path and modeled as S(n). Since the signal captured by the error microphone is the mix of the noise and the anti-noise, the noise is obtained via removing the anti-noise signal from the error microphone signal. It is critical to model the secondary path as accuracy as possible in the frequency range of interest because the audio input may negatively affect the NB ANC performance.

In accordance with the present invention, the high speed adaptive ANC system has the following advantages:

(1) There is less delay or low latency using hardware processing and the adaptive secondary path because the system operates at hardware speed.

(2) It requires little processing power because most of processing is done in other units and the processing in the unit has just three sets of filtering operations: wideband (WB) filtering, narrowband (NB) filtering, and secondary path filtering. In one embodiment, the infinite impulse response (IIR) filters are advantageously employed due to the small number of coefficients.

The novel feature in this system is that all of the coefficients are updated in real-time based on an error noise signal derived from an error signal provided by the error microphone and a feedback noise signal provided by the secondary path (feedback) filter. The hybrid noise cancellation device (unit) 210 will be described in more detail further below.

The coefficients of the WB ANC filter 211 and the NB ANC filter 212 in the hybrid noise cancellation device (unit) 210 are updated by the controller 217.

An hybrid adaptive ANC unit (HAANCU) according to an embodiment of the present disclosure is now described in detail below. The audio input AA(n) is alternatively referred to as AI(n).

Let the reference signal from reference microphone signal after ADC be XX(n) and error signal from the error microphone signal after ADC be EE(n), where n is a sampling time index, then YY(n) is the anti-noise signal plus the audio input (AI):

$$YY(n)=YB(n)+YZ(n)+\mathrm{AI}(n) \tag{1}$$

In which YB(n) is the output signal of the WB ANC and equals to $$YB(n)=XX(n)\otimes \mathrm{WB}(n) \tag{2}$$

WB(n) is the adaptive filter of WB ANC and the operator ⊗ is the convolution or filtering. Similarly, YZ(n) is the output signal of the NB ANC and equals to $$YZ(n)=\mathrm{EN}(n)\otimes \mathrm{NB}(n) \tag{3}$$

Where EN(n) the (error) noise signal in the inner ear area and NB(n) is the adaptive filter of the NB ANC. Note that EN(n) is not available because it depends on YY(n). One solution is to use one-sample delayed one. In order to compensate the delay, NB(n) filter is modified with one-sample ahead, which can be easily realized in the filter conversion unit. Thus, Eq. (3) must be modified as $$YZ(n)=\mathrm{EN}(n-1)\otimes \mathrm{NB1}(n) \tag{4}$$

Where NB1(n) is the same as NB(n) but with one sample ahead (i.e., ahead in time by a sampling interval) when the filter is applied to the same signal. let NB1(z) and NB(z) be the z-transform of NB1(n) and NB1(n), respectively, then $$\mathrm{NB1}(n,z)=\mathrm{NB}(n,z)z^{1} \tag{5}$$

In practice, the right side of Eq. (5) is not implemented. Thus, the left side is realized in the filter conversion unit. It is easier to do so because an infinite impulse response (IIR) filter is generally used.

Once YY(n) is computed, it is played out. In DSP or like device, we can have $$\mathrm{EN}(n)=EE(n)-YY(n)\otimes S(n) \tag{6}$$

The above mathematic operations can be implemented both in hardware and software. In one embodiment, hardware is used for the major operations and software is used to permit design flexibility.

Figure 3:
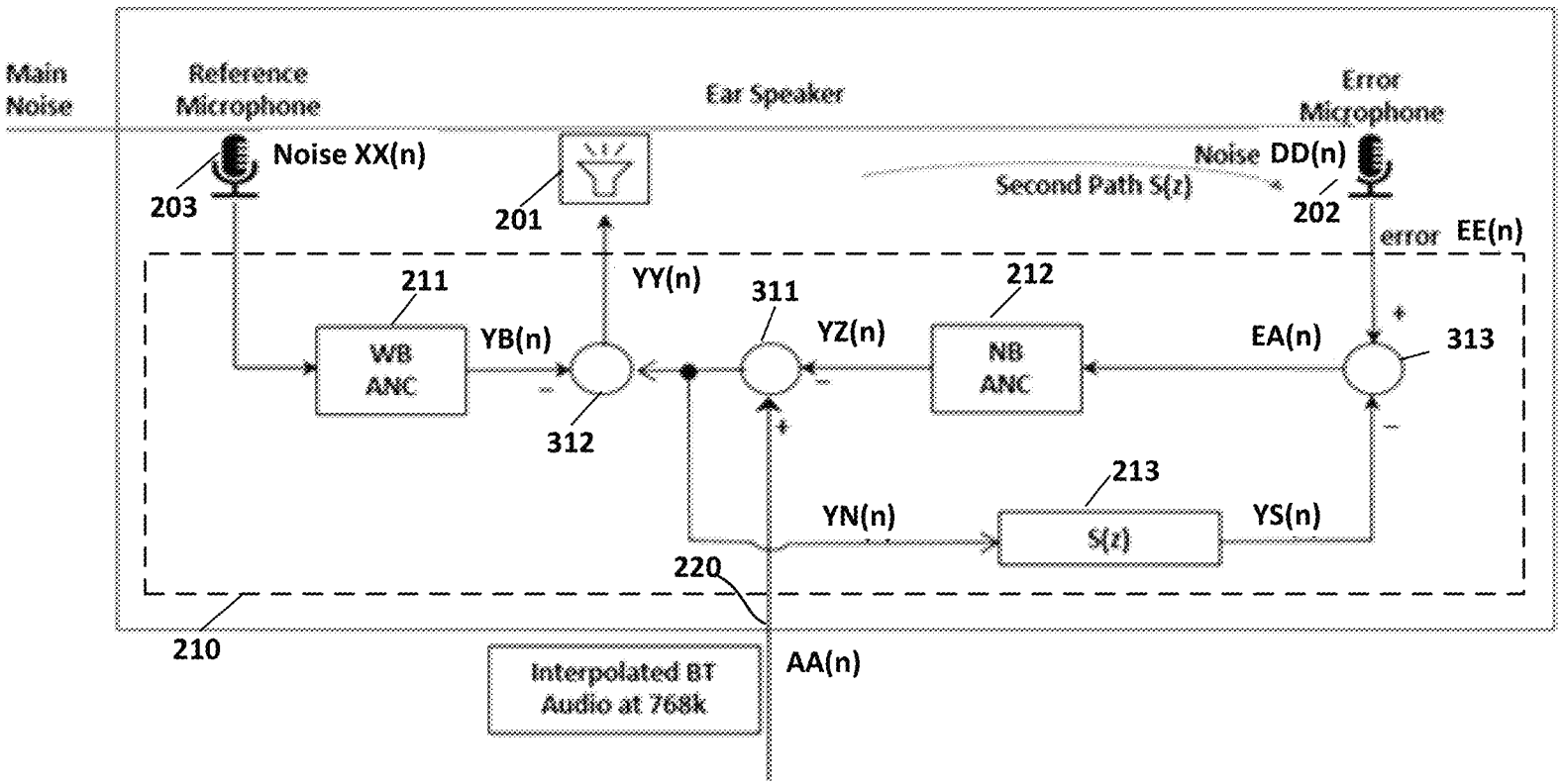
FIG. 3 is a simplified block diagram of an adaptive hybrid noise cancellation system when the adaptive ANC system including a secondary path is operating at high sampling rates according to another embodiment of the present disclosure.

FIG. 3 an example block diagram of an active noise cancellation system 300 according to another embodiment of the present disclosure. The main difference between the systems in FIG. 3 and FIG. 2 is the input to the NB ANC filter. Since only the feedback noise YS(n) is subtracted from the error signal EE(n) of the error microphone, the reference to the NB ANC filter 212 is a residual error noise signal EA(n) after the WB ANC filter. In this way, the NB ANC filter can focus on the low-frequency range and tonal-like peaks in the residual error noise signal EA(n) after the WB ANC operation.

Referring to FIG. 3, the hybrid adaptive active noise cancellation system 300 includes an audio transducer (e.g., an ear speaker) 201, an error microphone 202 positioned close to the ear speaker, and a reference microphone 203 integrated in the audio device. The HAANCU system 300 also includes a hybrid noise cancellation device (unit) 210, which includes a wideband adaptive noise cancellation (WB ANC) filter 211, a narrowband adaptive noise cancellation (NB ANC) filter 212, and a feedback filter 213 having an impulse response S(n) representing an acoustic path between the ear speaker and the error microphone. Their functions and operations have been described above and will not be repeated herein.

The hybrid adaptive active noise cancellation system 300 also includes a first adder 311 configured to generate a narrowband feedback signal YN(n) from the wideband anti-noise signal YB(n) at the output of the WB ANC filter 211, the NB anti-noise signal YZ(n), and a desired audio signal AA(n). The hybrid adaptive active noise cancellation system 300 also includes a second adder 312 coupled to the WB ANC filter and the first adder and configured to provide a noise-reduced audio signal YY(n) to the ear speaker. The hybrid adaptive active noise cancellation system 300 also includes a third adder 313 configured to generate a residual error signal EA(n) from the error signal EE(n) and the feedback signal YS(n).

Following is the description of mathematical operations according to FIG. 3. Only the difference from the mathematical operations from FIG. 2 is shown. The difference is the reference signal to the NB ANC filter 212. Similar to Eq. (4) and (5), we use NB1(n) so that $$YZ(n)=EA(n-1)\otimes \mathrm{NB1}(n) \tag{7}$$

Once YY(n) is computed, it is played out. In DSP or like device, we can have $$EA(n)=EE(n)-(YZ(n)+AA(n))\otimes S'(n) \tag{8}$$

Figure 4:
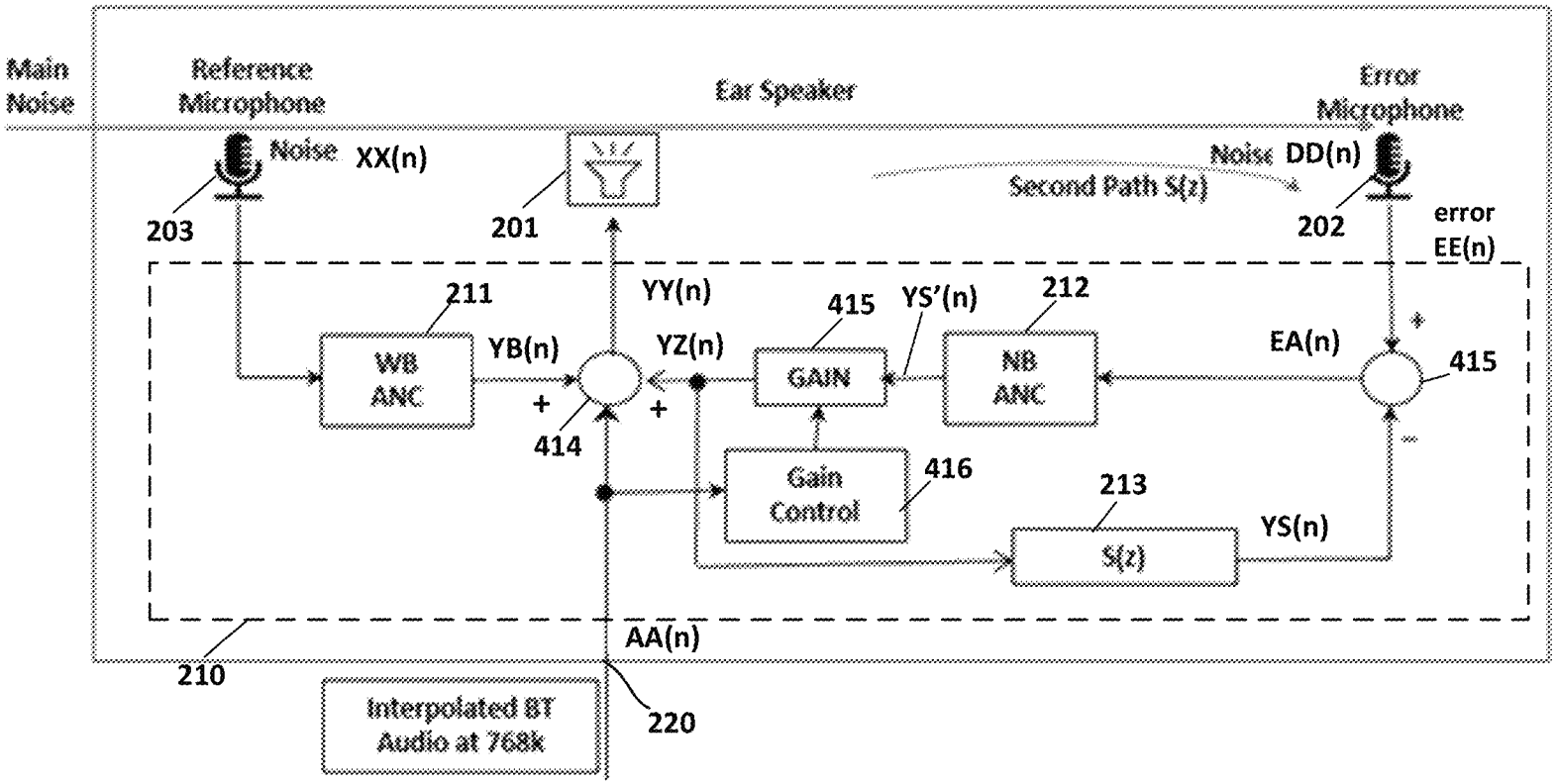
FIG. 4 is a simplified block diagram of an adaptive hybrid noise cancellation system when the adaptive ANC system including a secondary path is operating at high sampling rates according to still another embodiment of the present disclosure.

FIG. 4 is a simplified block diagram illustrating an HAANCU architecture used in an adaptive hybrid ANC system 400 according to an embodiment of the present disclosure. The main difference between the adaptive hybrid ANC system 400 and the adaptive hybrid ANC system 200 is that there is a GAIN circuit (e.g., an amplifier) 415 to adjust attenuation based on information of the audio signal to be played. The Gain circuit 415 is controlled by a gain control circuit 416 based on the amplitude of the audio signal AA(n) (alternatively refers to as audio input signal AI(n)). For example, since NB ANC performance depends on the accuracy of the secondary path model, the NB ANC effect can be reduced when the audio signal is strong by reducing the GAIN. In one embodiment, the GAIN can be set to zero when an audio active detection is positive.

Referring to FIG. 4, the hybrid adaptive active noise cancellation system 400 includes an audio transducer (e.g., an ear speaker) 201, an error microphone 202 positioned close to the ear speaker, and a reference microphone 203 integrated in the audio device. The HAANCU system 400 also includes a hybrid noise cancellation device (unit) 210, which includes a wideband adaptive noise cancellation (WB ANC) filter 211, a narrowband adaptive noise cancellation (NB ANC) filter 212, and a feedback filter 213 having an impulse response S(n) representing an acoustic (secondary) path between the ear speaker and the error microphone. Their functions and operations have been described above and will not be repeated herein.

The hybrid adaptive active noise cancellation system 400 also includes a first adder 414 configured to provide a noise-reduced signal YY(n) to the ear speaker from a wideband anti-noise signal YB(n) at the output of the WB ANC filter 211, an amplified (scaled) narrowband anti-noise YZ(n) at the output of the variable gain amplifier (GAIN) 415 which receives an NB anti-noise YZ'(n) from the NB ANC filter 212, and a desired audio signal AA(n). The hybrid noise cancellation device (unit) 210 also includes a second adder 415, which sums a feedback noise signal YS(n) at the output of the feedback filter S(n) and the error signal EE(n) to generate an error noise signal EA(n) to the NB ANC filter 212.

Following is the mathematical description of FIG. 4 in addition to the mathematical operations shown in FIG. 3. Referring to FIG. 4, YS'(n) is the output signal of the NB ANC filter 212, which is similar to YZ(n) in FIG. 3. YZ(n) in this architecture is $$YZ(n)=GYS'(n) \tag{9}$$

Where G is a gain less than or equal to one and it is a function of AA(n). For example, if absolute value of AA(n) is above a threshold, G=0. In other case, it is related to any soft-VAD variable.

There are many other realizations of high-speed hybrid ANC. For example, some embodiments of the feedback ANC directly use signal of the error microphone as its input. The principle is based on the control theory and NB ANC design is a controller design. Many analog NB ANC filters are based on this principle.

III. Adaptive Hybrid ANC Training Unit (AHANCTU)

Signal processing for obtaining filter coefficients are performed in this unit, which typically is a DSP or the like. Signals to the unit are with lower sampling rates so that the signal processing operations requires much lower processing power and computational complexity as measured in MIPS (millions of instructions/s) and memory than when directly processing in a high-speed (high sampling rate) unit.

Referring to FIG. 1C, signals from both the reference microphone and error microphone are decimated to lower sampling rates. The rate running in a DSP device depends on the frequency range of ANC to achieve noise reduction and ANC performance specifications. In an example embodiment, performance requirements are specified up to 4 kHz, the sampling rate for signals processed in DSP can be 8 ksamples/s. Other sampling rates can be used while 8 ksamples/s may be optimal in terms of processing and memory cost.

Figure 5:
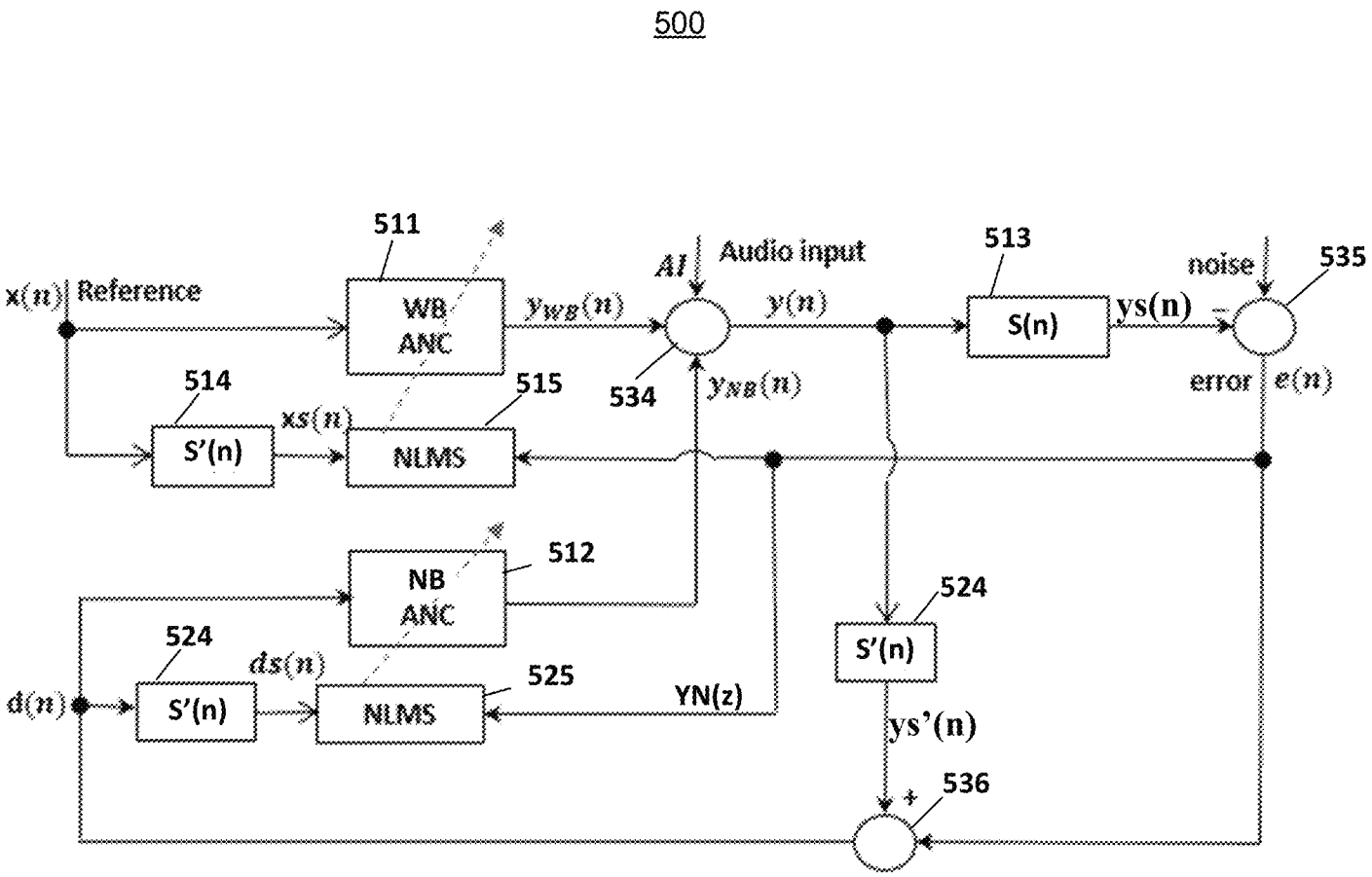
FIG. 5 is a simplified block diagram of an adaptive hybrid noise cancellation system with an additional modeled secondary path operating at low sampling rates according to an embodiment of the present disclosure.

FIG. 5 is a simplified block diagram of an active noise cancellation system 500 operating at low sampling rates according to an embodiment of the present disclosure. The active noise cancellation system 500 is shown to include adaptation of filters for hybrid WB and NB ANCs in a low sampling rate unit. The active noise cancellation system 500 has a structure similar to that shown in FIG. 2 with the exception that there are adaptation blocks in the training unit. However, it is running in a much lower sampling rate and preferred to be realized with software via DSP or like device. It also includes an adaptation block which is not required for high speed unit as shown in FIG. 2. Referring to FIG. 5, the active noise cancellation system 500 includes a wideband adaptive noise cancellation (WB ANC) filter 511, a narrow band adaptive noise cancellation (NB ANC) filter 512, a feedback filter S(n) 513 which represents the impulse response of the secondary path, and a modeled feedback filter S'(n) 514 which is a modeling of the secondary path S(n) at a lower sampling rate. Note that S(n) herein is a low-sampling rate version of S(n) in FIGS. 2, 3, and 4, where sampling rate is much high. Another point is that S(n) is not available and it is the same as S'(n) in this unit. The modeling of the secondary path will be trained. The active noise cancellation system 500 also includes a first adder 534 configured to provide a noise-reduced audio signal from the wideband anti-noise signal $y_{WB}(n)$, the narrowband anti-noise signal $y_{NB}(n)$ and a desired audio signal AI. The active noise cancellation system 500 also includes a second adder 535 configured to provide an error signal e(n) from the noise signal "noise" from the error microphone (not shown) and the feedback noise signal ys(n) of the feedback filter S(n). The active noise cancellation system 500 further includes a first normalized least mean square (NLMS) filter circuit 515 disposed between the first modeled feedback filter S'(n) 514 and the second adder 535 and a second NLMS filter circuit 525 disposed between the second modeled feedback filter S'(n) 524 and the second adder 535. The first and second NLMS filter circuits 515, 525 can be a normalized least mean square (NLMS) adaptive algorithm or other adaptive filtering algorithms. The active noise cancellation system 500 further includes a third adder 536 configured to provide a noise signal d(n) from a modeled feedback noise signal ys'(n) and the error signal e(n). The noise signal d(n) is to be canceled at the error microphone and is used as NLMS reference for train NB ANC filter. In one exemplary embodiment, the reference noise signal x(n), the desired audio input signal AI, the noise signal picked up by the error microphone are down-sampled to 48 ksamples/s, such that the active noise cancellation system 500 can be operated at a very clock frequency.

The WB ANC filter 511 is adaptively trained with the reference microphone signal x(n) as reference and the error microphone signal for WB filter update. The NB ANC filter 512 is adaptively trained with noise signal d(n) as reference and error microphone signal e(n) for NB filter update. For a more detailed description, see the above identified incorporated by reference co-pending U.S. Pat. No. 10,950,213, entitled ""Hybrid Active Noise Cancellation Filter Adaptation."

Figure 6:
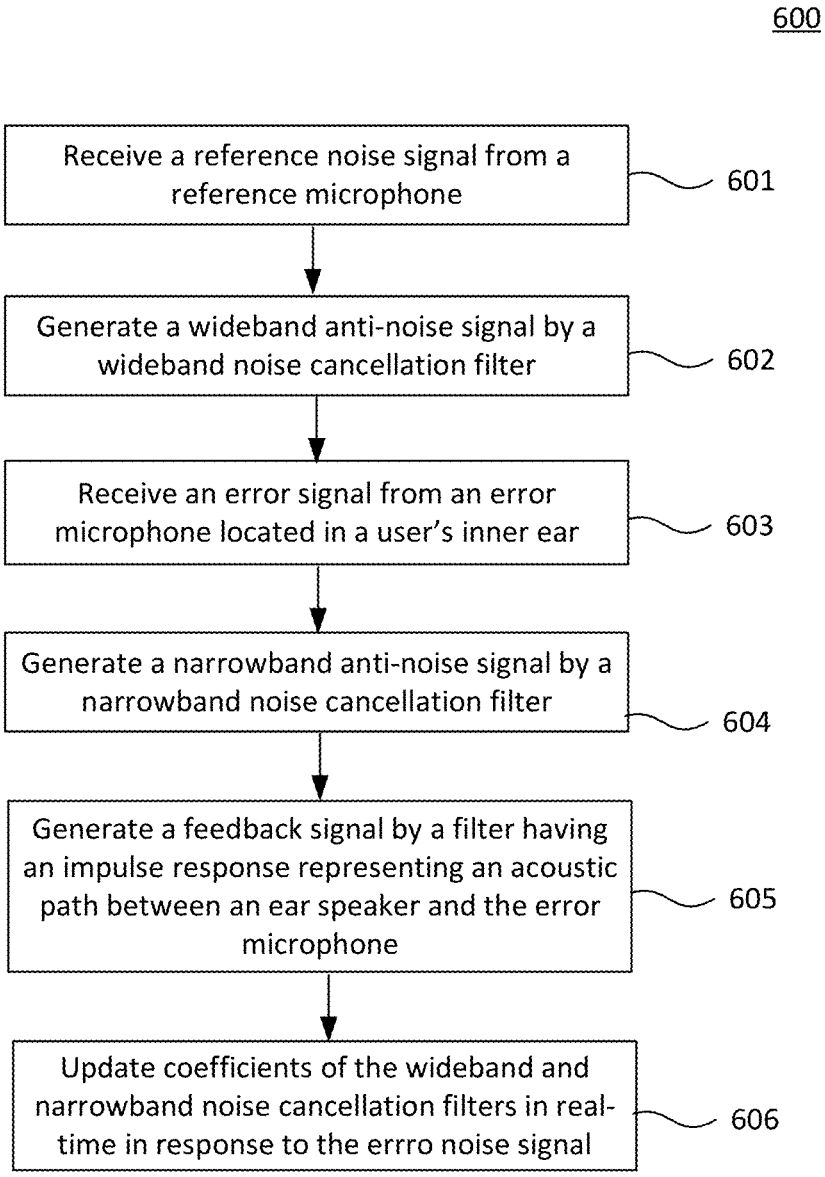
FIG. 6 is a simplified flowchart of an exemplary method for performing active noise cancellation according to some embodiments of the present disclosure.

FIG. 6 is a simplified flowchart of an exemplary method 600 for performing active noise cancellation in an audio signal utilizing a hybrid noise cancellation apparatus including a wideband active noise cancellation (ANC) filter, a narrowband ANC filter, and a feedback filter according to some embodiments of the present disclosure. According to some embodiments, the steps may be combined, performed in parallel, or performed in a different order. The method 600 may also include addition or fewer steps than those shown in FIG. 6. In step 601, a reference noise is received from a reference microphone, the received reference noise signal is converted into a digital reference noise signal using, e.g., a first oversampling analog-digital converter ADC 103, as shown in FIG. 1A. In step 602, a wideband anti-noise signal is generated by applying the wideband active noise cancellation filter having a first bandwidth to the reference noise signal. In step 603, an error signal is received by an error microphone. The error signal is converted into a digital error signal by a second oversampling analog-digital converter ADC 113, as shown in FIG. 1A. In one embodiment, the first and second oversampling analog-digital converters may be integrated in a single oversampling analog-digital converter integrated circuit. On one embodiment, the data conversion of the reference noise signal and the error signal may be performed by a same oversampling analog-digital converter. In step 604, a narrowband anti-noise signal is generated from an error noise signal by a narrowband noise cancellation filter having a second bandwidth that is smaller than the first bandwidth. Referring to FIG. 2, the error noise signal EN(n) is applied to the NB ANC filter 212 which generates a narrow band anti-noise signal YZ(n). In step 605, a feedback signal is generated by the feedback filter having an impulse response representing an acoustic path between an ear speaker and the error microphone. In one embodiment, the feedback filter has an input connected to an input of the ear speaker for receiving a digital signal before it is converted to an analog signal by a DAC for outputting to the ear speaker, as shown in FIG. 1A and FIG. 2. In some embodiments, the error noise signal is generated by combining the feedback noise signal YS(n) and the error signal EE(n), as shown in FIG. 2. In step 606, the method 600 also includes updating the filter coefficients of the wideband active noise cancellation filter (e.g., WB ANC 211) and the narrowband active noise cancellation filter (e.g., NB ANC 212), as shown in FIG. 2. In one embodiment, the wideband noise cancellation filter and the narrowband noise cancellation filter each may include one or more infinite impulse response filters. In one embodiment, the wideband active noise cancellation filter and the narrowband active noise cancellation filter may be implemented by a digital signal processor, and the filter coefficients are stored in a data storage or memory, such as registers, latches, or SRAM.

In one embodiment, the method further includes receiving an audio signal at an input terminal of the noise cancellation apparatus. The audio signal may be a digital signal having a sampling rate different from the sampling rate of the reference signal and the error signal. For example, the audio signal may be compressed audio data from a compact disc (CD), an MP3 player, and the like. In this case, the method may further include applying an interpolation operation to the audio signal to increase the sampling rate to the same sampling rate as that of the ADCs 103 and 113. In one embodiment, the interpolation operation may be performed by a digital signal processor. In another embodiment, the interpolation operation may be performed by an interpolation circuit.

In some embodiments, the noise cancellation apparatus may include the hybrid noise cancellation device (unit) 210 as shown in FIGS. 2 to 4. In some embodiments, the noise cancellation apparatus may include a plurality of adders or combiners, such as adders 214 and 215 in FIG. 2, adders 311, 312, and 313 in FIG. 3, and adders 414 and 415 in FIG. 4. The adders are coupled directly or indirectly to the wideband and narrowband noise cancellation filters. In some embodiments, the update of the filter coefficients may be performed by a digital signal processor, a coefficient processor, a microcontroller, or the update of the filter coefficients may be implemented as software instructions executed by one or more digital signal processors. In one embodiment, the ADCs 103 and 113 may be components of the reference microphone and the error microphone, respectively.

The embodiments disclosed herein are not limited in scope by the specific embodiments described herein. Various modifications of the embodiments of the present invention, in addition to those described herein, will be apparent to those of ordinary skill in the art from the foregoing description and accompanying drawings. Further, although some of the embodiments of the present invention have been described in the context of a particular implementation in a particular environment for a particular purpose, those of ordinary skill in the art will recognize that its usefulness is not limited thereto and that the embodiments of the present invention can be beneficially implemented in any number of environments for any number of purposes.

What is claimed is:

1. An apparatus for cancelling noise, the apparatus comprising:

a reference microphone configured to receive a reference noise signal;

an error microphone configured to receive an error signal;

a hybrid noise cancellation unit coupled to the reference microphone and the error microphone and comprising:

a first noise cancellation filter having a first bandwidth and configured to generate a first anti-noise signal from the reference noise signal and provide the first anti-noise signal to an ear speaker;

a second noise cancellation filter having a second bandwidth smaller than the first bandwidth and configured to generate a second anti-noise signal from an error noise signal derived from the error signal;

a filter between the ear speaker and the error microphone and configured to generate a feedback noise signal from the first anti-noise signal and the second anti-noise signal; and a controller configured to reduce the error noise signal through an update of coefficients of the first noise cancellation filter and the second noise cancellation filter in response to the first anti-noise signal, the second anti-noise signal, and the feedback noise signal.

2. The apparatus of claim 1, wherein the error noise signal is applied to the second noise cancellation filter with a sample ahead of the second anti-noise signal by a sample time interval.

3. The apparatus of claim 1, wherein the second noise cancellation filter comprises an infinite impulse response filter.

4. The apparatus of claim 1, further comprising:

a first adder configured to generate a noise-reduced audio signal from the first anti-noise signal, the second anti-noise signal, and an audio signal provide to the apparatus, wherein the noise-reduced audio signal is provided to the ear speaker; and a second adder configured to generate the error noise signal from the feedback noise signal and the error signal.

5. The apparatus of claim 4, further comprising:

a variable gain amplifier disposed between the second noise cancellation filter and the first adder and configured to provide a scaled narrowband anti-noise signal to the first adder to further improve noise cancellation of the audio signal.

6. The apparatus of claim 4, wherein the audio signal is a digital audio signal comprising interpolated samples of an analog audio signal at a sampling frequency and provided to the apparatus through a digital input port.

7. The apparatus of claim 1, further comprising:

a third adder configured to generate a feedback signal from the second anti-noise signal and an audio signal;

a fourth adder coupled to the first noise cancellation filter and configured to provide a noise-reduced audio signal to the ear speaker; and a fifth adder coupled to the filter and configured to generate a residual error signal from the error signal and the feedback noise signal.

8. An apparatus for canceling noise, the apparatus comprising:

a first active noise cancellation (ANC) filter having a first bandwidth and configured to provide a first anti-noise signal to an ear speaker from a reference noise signal;

a second ANC filter having a second bandwidth smaller than the first bandwidth and configured to provide a second anti-noise signal to the ear speaker from an error noise signal derived from an error microphone;

a filter disposed between the ear speaker and the error microphone and configured to generate a feedback noise signal from the first anti-noise signal and the second anti-noise signal; and a controller configured to reduce the error noise signal through an update of coefficients of the first ANC filter and the second ANC filter in response to the first anti-noise signal, the second anti-noise signal, and the feedback noise signal.

9. The apparatus of claim 8, wherein the error microphone is a digital error microphone, and the reference noise signal is received from a digital reference microphone, the digital error microphone and the digital reference microphone being embedded in the apparatus.

10. The apparatus of claim 8, wherein the error noise signal is applied to the second ANC filter with a sample ahead of the second anti-noise signal by a sample time interval.

11. The apparatus of claim 8, further comprising:

a first adder configured to sum the first anti-noise signal, the second anti-noise signal, and a digital audio signal to provide a noise-reduced digital audio signal to the ear speaker; and a second adder configured to generate the error noise signal from the feedback noise signal and an error signal of the error microphone.

12. The apparatus of claim 11, further comprising:

a variable gain amplifier disposed between the second ANC filter and the first adder and configured to provide a scaled narrowband anti-noise signal to the first adder to further improve noise cancellation of the digital audio signal.

13. The apparatus of claim 8, further comprising:

a third adder coupled to the second ANC filter and configured to generate a feedback signal from the second anti-noise signal and a digital audio signal;

a fourth adder coupled to the first ANC filter and configured to provide a noise-reduced audio signal to the ear speaker; and a fifth adder coupled to the filter and configured to generate a residual error signal from an error signal of the error microphone and the feedback noise signal.

14. A method for canceling noise in an audio signal, the method comprising:

receiving a reference noise signal from a reference microphone;

generating a first anti-noise signal by applying a first noise cancellation filter having a first bandwidth to the reference noise signal;

receiving an error signal from an error microphone;

generating a second anti-noise signal by applying a second noise cancellation filter to an error noise signal associated with the error signal, the second noise cancellation filter having a second bandwidth smaller than the first bandwidth;

generating a feedback signal by a filter disposed between an ear speaker and the error microphone from the first anti-noise signal and the second anti-noise signal; and reducing the error noise signal by updating coefficients of the first noise cancellation filter and the second noise cancellation filter.

15. The method of claim 14, wherein updating the coefficients of the first noise cancellation filter and the second noise cancellation filter comprises:

computing a difference between the error signal and the feedback signal to obtain the error noise signal; and adjusting the coefficients of the first noise cancellation filter and the second noise cancellation filter to minimize the error noise signal.

16. The method of claim 14, wherein the error noise signal is provided to the second noise cancellation filter with a sample ahead of the second anti-noise signal by a sample time interval.

17. The method of claim 14, wherein the second noise cancellation filter comprises an infinite impulse response filter.

18. The method of claim 14, further comprising:

adding the first and second anti-noise signals to the audio signal to obtain a noise-canceled audio signal; and providing the noise-canceled audio signal to the ear speaker.

19. The method of claim 18, wherein the first and second anti-noise signals and the audio signal are discrete time domain signals.

20. The method of claim 19, further comprising:

applying an interpolation operation to the audio signal to have a same sampling rate as the first and second anti-noise signals.

* * * * *